US006376443B1

(12) United States Patent
Julemont

(10) Patent No.: US 6,376,443 B1
(45) Date of Patent: Apr. 23, 2002

(54) BATHROOM CLEANING WIPE COMPRISING ANTIRAIN OR ANTIDUST AGENT

(75) Inventor: Jean Julemont, Verviers (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/993,244

(22) Filed: Nov. 14, 2001

(51) Int. Cl.[7] ..... C11D 3/22; C11D 17/00

(52) U.S. Cl. ..... 510/238; 510/424; 510/438; 510/477; 510/499; 510/506

(58) Field of Search ..... 510/238, 438, 510/424, 477, 499, 506; 428/195; 134/64 R

(56) References Cited

U.S. PATENT DOCUMENTS 6,190,678 B1 * 2/2001 Hasenoehrl et al. ..... 424/401
6,338,855 B1 * 1/2002 Albacarys et al. ..... 424/409

* cited by examiner

*Primary Examiner*—Necholus Ogden
(74) *Attorney, Agent, or Firm*—Richard E. Nanfeldt

(57) ABSTRACT

A cleaning wipe comprising a water insoluble substrate being impregnated with a cleaning composition.

5 Claims, No Drawings

BATHROOM CLEANING WIPE COMPRISING ANTIRAIN OR ANTIDUST AGENT

FIELD OF INVENTION

The present invention relates to a water insoluble substrate which has been impregnated with a liquid bathroom cleaning composition.

BACKGROUND OF THE INVENTION

The patent literature describes numerous wipes for both body cleaning and cleaning of hard surfaces but none describe the instant bathroom cleaning wipes which have improved cleaning characteristics on typical bathroom grime in the minimization of streaking and residue.

U.S. Pat. Nos. 5,756,612; 5,763,332; 5,908,707; 5,914,177; 5,980,922 and 6,168,852 teach cleaning compositions which are inverse emulsions.

U.S. Pat. Nos. 6,183,315 and 6,183,763 teach cleaning compositions containing a proton donating agent and having an acidic pH.

U.S. Pat. Nos. 5,863,663; 5,952,043; 6,063,746 and 6,121,165 teaches cleaning compositions which are emulsions.

SUMMARY OF THE INVENTION

A bathroom cleaning wipe comprising a water insoluble substrate, which impregnated with a liquid bathroom cleaning composition containing a zwitterionic surfactant, a cosurfactant, an alkanol, a quaternary alkylol amine salt, a preservative, a proton donating agent, triethanol amine and water, wherein the liquid bathroom cleaning composition is not an emulsion and does not contain an anionic surfactant, proteins, metallic salts, enzymes, amides, sodium hypochlorite, dimethicone, N-methyl-2-pyrrolidone, monoalkyl phosphate or silicon based sulfosuccinate.

DETAILED DESCRIPTION OF THE INVENTION

The present invention relates to a bathroom cleaning wipe which comprises approximately:

(a) 30 wt. % to 40 wt. % of a water insoluble substrate; and (b) 60 wt. % to 70 wt. % of a liquid bathroom cleaning composition being impregnated in said water insoluble substrate, wherein said liquid bathroom cleaning composition comprises:

(i) 0.1 wt. % to 5 wt. %, more preferably 0.25 wt. % to 4 wt. % of a zwitterionic surfactant;

(ii) 0.5 wt. % to 10 wt. %, more preferably 1 wt. % to 6 wt. % of a $C_1$–$C_4$ alkanol;

(iii) 0.5 wt. % to 8 wt. %, more preferably 1 wt. % to 5 wt. % of a cosurfactant;

(iv) 0.1 wt. % to 1 wt. %, more preferably 0.2 wt. % to 0.8 wt. % of an antirain or antidust agent, a cationic quaternary alkylolamine salt, or choline chloride;

(v) 0 to 0.25 wt. %, more preferably 0.01 wt. % to 0.1 wt. % of a perfume;

(vi) 0 to 0.1 wt. %, more preferably 0.01 wt. % to 0.1 wt. % of a preservative such as iodo propynyl butyl carbamate;

(vii) 0.05% to 3.0% of a proton donating agent;

(viii) 0 to 1% of triethanol amine; and (ix) the balance being water, wherein the composition has a pH of about 3 to about 7, more preferably about 3.5 to about 6.

The water-soluble zwitterionic surfactant, which is an essential ingredient of present liquid detergent composition, provides good foaming properties and mildness to the present liquid cleaning composition. The zwitterionic surfactant is a water soluble betaine having the general formula:

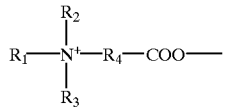

wherein $R_1$ is an alkyl group having 10 to 20 carbon atoms, preferably 12 to 16 carbon atoms, or the amido radical:

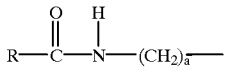

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethyl-ammonia)acetate, coco dimethyl betaine or 2-(N-coco N,N-dimethylammonio)acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc. The instant compositions show a marked improvement in ecotoxocity as compared to existing commercial products.

The cosurfactants in the instant compositions are selected from the group consisting of polypropylene glycol of the formula $HO(CH_3CHCH_2O)_nH$ wherein n is a number from 1 to 18, and mono and di $C_1$–$C_6$ alkyl ethers and esters of ethylene glycol and propylene glycol having the structural formulas $R(X)_nOH$, $R_1(X)_nOH$, $R(X)_nOR$ and $R_1(X)_nOR_1$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1methoxy-2-propanol, 1methoxy-3-propanol, and 1methoxy 2-, 3- or 4-butanol.

Representative members of the polypropylene glycol include dipropylene glycol and polypropylene glycol having a molecular weight of 150 to 1000, e.g., polypropylene glycol 400. Satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. While all of the aforementioned glycol ether compounds provide the described stability, the most preferred cosurfactant is propylene glycol N-butyl ether.

The proton donating agent is preferably an alpha hydroxy aliphatic acid which is selected from the group consisting of citric acid, lactic acid, salicylic acid, tartaric acid, fumaric acid, glutaric acid, succinic acid, adipic acid and glycolic acid and mixtures thereof.

The preferred $C_1$–$C_4$ alkanols are ethanol or isopropanol and mixtures thereof The final essential ingredient in the instant is water. The proportion of water in the compositions generally is in the range of 70 wt. % to 98.5 wt. %.

The liquid bathroom cleaning composition of this invention may, if desired, also contain other components either to provide additional effect or to make the product more attractive to the consumer. The following are mentioned by way of example: Colors or dyes in amounts up to 0.5% by weight; chelating agents such as ethylene diamine tretraacetic acid, ethylene diamine N,N disuccinic acid, methylglycine N,N diacetic acid, glutamic N,N diacetic acid, phosphonic acid and salt thereof; preservatives, such as formalin, 5-bromo-5-nitro-dioxane,2-bromo-2-nitropropane-1,3-diol, methylisothiazolone, 5-chloro-2-methyl-4-isothaliazolin-3-one, 1,3dimethylol-5,5-dimethylhydantoin and mixture thereof; antioxidizing agent such as 2,6-di-tert.butyl-p-cresol and tetradibutyl pentaerithrityl hydroxyhydrocinnamate; UV-light absorber, etc., in amounts up to 2% by weight; and pH adjusting agents, such as sulfuric acid or sodium hydroxide, as needed.

The liquid bathroom cleaning compositions are prepared by simple batch mixing at 25° C.–30° C. The nonwoven fabric is impregnated with the liquid bathroom cleaning composition by means of a positive impregnation process. The liquid is positively fed into the nonwoven fabric through a controlled gear pump and injection bar at a ratio of about 2.2 (double face nw) and 2.4 (hydraspun) grams of liquid bathroom cleaning composition to about 1 gram of the nonwoven fabric.

One of the nonwoven fabric which is manufactured by Ahsltrom/Dexter Corporation under the name Hydraspun comprises about 60% to 95% of wood pulp fabrics, 2.5 wt. % to 20 wt. % of viscose fibers and 2.5 wt. % to 20 wt. % of polyester fibers. Excluded as substrates for the wipes are any nonwoven fabric substitute that does not contain at least 50 wt. % of wood pulp fibers such as Spunlace nonwoven fabric substrate.

The second non woven also available from Ahlstrom/Dexter corporation is an hydroentangled non woven (fiber composition similar to hydraspun, but additional chemical binder used for non woven reinforcement as well as reticulable "coarse" synthetic fibers (Polyethylene, Polypropylene) added to one side of non woven to create a scrubbing side.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following liquid bathroom cleaning wipes were made by the aforementioned process. The aim of the test is to show the superiority in residue and limescale removal of hydraspun non woven with the bath fla (formula A) in comparison to same hydraspun but with all purpose-antibacterial fla (patent F1495) (formula B).

| | A Wt. % |
|---|---|
| Part I | |
| Propylene glycol N-butyl ether | 3.0 |
| Ethanol | 3.0 |
| Cocoamido propyl dimethyl betaine | 0.75 |
| Quaternary alkylol amine salt Avitex DN (DuPont Chemical) | 0.5 |
| Perfume | 0.05 |
| Iodopropynyl butyl carbamate | 0.03 |
| Lactic acid | 0.75 |
| Triethanol amine | 0.32 |
| Water | 92.7 |
| Part II | |
| Part I | 70.59% |
| Hydraspun 8579 | 29.41% |

| | B Wt. % |
|---|---|
| Part I | |
| Propylene glycol N-butyl ether | 3.0 |
| Ethanol | 1.0 |
| Cocoamido propyl diamethyl betaine | 2.0 |
| C9–C11 alcohol EO7.5–8:1 nonionic | 2.0 |
| Perfume | 0.6 |
| C9–C11 alcohol EO2.5:1 nonionic | 0.37 |
| Bardac 2170 | 0.72 |
| Water | Bal. |
| Part II | |
| Part I | 73.68 |
| Hydapun 8579 | 26.32 |

Formulas A and B were tested for residue pattern on Perspex tiles and rated on a 10 point scale (0=very poor/much residue and 10=very good/no residue).

| | A | B |
|---|---|---|
| Residue on Perspex tiles | 6.2 | 3.4 Residue test |

consist in:

15 cm×15 cm Perspex black tiles wiped with the impregnated test substrate in a circular movement such that the middle of the tile is wet and contours kept dry.

Each test product is applied on 5 different tiles (=5 replicates), then 5 judges score the residue pattern (observation made under indirect light conditions) of each tile from 0=very poor residue score up to 10=excellent, no residue on a 10 point scale. Results are then analyzed statistically. In case of current test, Perspex tiles were judged under indirect light conditions while mirror tiles were observed under razing light obtained with high power halogen lamp allowing to simulate sun light condition and therefore highlighting even low residue results.

Limescale removal:

In addition to the residue test, due to acidic base formula, formula A is found better to formula B in terms of lime scale removal. For evaluating this behavior, stainless steel plates are sprayed with hard water and let in an oven to evaporate, this cycle being repeated 10 times to have enough visible limescale. When wiping with each individual wipe made with either formula A and B, one can observe that removal of limescale is significantly easier with formula A than with formula B.

| | A | B |
|---|---|---|
| Limescale removal | +++ | + |

Further to the use of hydraspun as non woven, it was also discovered that the use of double side non woven (with scrubbing side) could further enhance the cleaning ability on specific bathroom soils like limescale and soap scum.

| | A Wt. % | C Wt. % |
|---|---|---|
| Part I | | |
| Propylene glycol N-buty ether | 3.0 | 3.0 |
| Ethanol | 3.0 | 3.0 |
| Cocoamido propyl dimethyl betaine | 0.75 | 0.75 |
| Quaternary alkylol amine salt Avitex DN (DuPont Chemical) | 0.5 | 0.5 |

-continued

| | A Wt. % | C Wt. % |
|---|---|---|
| Perfume | 0.05 | 0.05 |
| Iodopropynyl butyl carbamate | 0.03 | 0.03 |
| Lactic acid | 0.75 | 0.75 |
| Triethanol amine | 0.32 | 0.32 |
| Water | 92.7 | 92.7 |
| Part II | | |
| Part I | 70.59% | 65.75% |
| Hydrospun 8579 | 29.41% | |
| Double face | | 31.25% |

Tests were performed manually on presoiled tiles either with artificial soap scum on ceramic tile or with limescale on stainless steel tiles. Results are as follows:

| | A | C |
|---|---|---|
| Limescale removal | +++ | ++++ |
| Soap scum removal | +++ | ++++ |

What is claimed:

1. A bathroom cleaning wipe which comprises approximately:

(a) 30 wt. % to 40 wt. % of a water insoluble substrate; and (b) 60 wt. % to 70 wt. % of a liquid cleaning composition being impregnated in said nonwoven fabric, wherein said liquid cleaning composition comprises:
(i) 0.1 wt. % to 5 wt. % of a zwitteronic surfactant;
(ii) 0.5 wt. % to 10 wt. % of a $C_1$–$C_4$ alkanol;
(iii) 0.5 wt. % to 8 wt. % of a glycol ether;
(iv) 0.1 wt. % to 1 wt. % of an antirain or antidust agent selected from the group consisting of choline chloride or a cationic quaternary alkylolamine salt;
(v) 0.05% to 3.0% of a lactic acid; and
(vi) the balance being water, wherein the composition has a pH of about 3 to about 7.0.

2. The cleaning wipe of claim 1, wherein said $C_1$–$C_4$ alkanol is ethanol or isopropanol.

3. The cleaning wipe of claim 1, wherein said glycol ether is propylene glycol N-butyl ether.

4. The cleaning wipe of claim 1 further including a perfume.

5. The cleaning wipe of claim 4 further including iodopropynyl butyl carbamate.

* * * * *